United States Patent [19]

Eriksson

[11] Patent Number: 4,861,433

[45] Date of Patent: Aug. 29, 1989

[54] DEWATERING PRESS WITH PERFORATED METAL OUTER SHELL AND RESILIENT ELASTIC MOUNTING MEANS

[75] Inventor: Hans E. K. Eriksson, Sundsvall, Sweden

[73] Assignee: Sunds Defibrator Aktiebolag, Sweden

[21] Appl. No.: 327,353

[22] Filed: Mar. 21, 1989

Related U.S. Application Data

[63] Continuation of Ser. No. 07/130,453, Nov. 13, 1987, abandoned.

[51] Int. Cl.[4] ..... D21F 1/60; D21F 1/74; D21F 3/08

[52] U.S. Cl. ..... 162/323; 100/121; 162/357; 210/326; 29/121.3

[58] Field of Search ..... 162/323, 358, 357; 100/121, 155 R, 90; 210/402, 326; 29/121.1, 121.2, 121.3, 130, 132

[56] References Cited

U.S. PATENT DOCUMENTS

| | | | |
|---|---|---|---|
| 1,793,688 | 2/1931 | Gardella | 29/121.1 |
| 2,332,917 | 10/1943 | Jordan et al. | 29/121.1 |
| 2,991,218 | 7/1961 | Cirrito et al. | 162/357 |
| 3,121,660 | 2/1964 | Hall, Jr. | 162/348 |
| 3,141,817 | 7/1964 | Collins et al. | 29/121.1 |
| 3,460,467 | 8/1969 | Nystrom | 210/402 |
| 3,730,079 | 5/1973 | Stirk et al. | 100/121 |
| 4,543,161 | 9/1985 | Fujimoto | 162/323 |

*Primary Examiner*—Karen Hastings
*Attorney, Agent, or Firm*—Lerner, David, Littenberg, Krumholz & Mentlik

[57] ABSTRACT

A pulp dewatering apparatus is constructed of two press rolls arranged juxtaposed to define a nip region. At least one of the press rolls is constructed of a perforated metal outer shell surrounding a substantially rigid inner roll body. A layer of elastic material is disposed between the rigid roll body and the perforated metal shell to provide a resilient member. As a result of the elastic material, this press roll will deform during the dewatering operation to provide an extended nip region of about 3 to 5% of the overall press roll diameter.

10 Claims, 1 Drawing Sheet

DEWATERING PRESS WITH PERFORATED METAL OUTER SHELL AND RESILIENT ELASTIC MOUNTING MEANS

This is a continuation of application Ser. No. 07/130,453 filed 11/13/87 now abandoned, and as described and claimed in International application PCT/SE 87/00169 filed 4/1/87.

BACKGROUND OF THE INVENTION

The present invention relates to pulp dewatering presses, and particularly relates to presses comprising two press rolls for pulp dewatering.

Pulp dewatering presses are used to increase the dry solids content of pulp suspensions from some lower percent to 40–50 percent. A press comprises two press rolls located in a trough to which a suspension of pulp is supplied. The press rolls are provided with perforated shell surfaces through which dewatering takes place. On a perforated shell surface, a pulp layer is formed which, by rotation of the rolls, is passed into the nip between the rolls. The extent of dewatering and resulting solids concentration of the pulp can be determined by controlling the speed of the rolls, the pressure difference over the pulp web on the perforated surface, and the distance between the rolls, which is defined as the nip.

The shell surfaces of the press rolls usually are manufactured of perforated sheet metal to resist the high pressures arising in the nip. The maximum pressure in the nip occurs in a linear direction where the nip is narrowest. Too high a linear pressure, however, can damage the fibers in the pulp, and this high pressure places higher stress on the equipment.

To prevent damage to both pulp fibers and the dewatering equipment, it is desirable in the dewatering of many pulp suspensions to distribute the maximum pressing force over a greater surface area. This is accomplished through the use of press rolls with surface elasticity. In the past, equipment manufacturers have attempted to obtain surface elasticity simply by providing conventional press rolls with an elastic shell surface. However, because of the pressure involved, these elastic shell surfaces were subject to wear and deformation at a greater rate than conventional press roll surfaces.

A pulp dewatering press is desired wherein one or both press rolls have a resilient surface yet resist wear and deformation in a manner comparable to the surfaces of conventional nonresilient press rolls used in such presses.

SUMMARY OF THE INVENTION

According to the present invention, it has been found that the resilience of press rolls in pulp dewatering equipment can be materially enhanced without detracting from the resistance of the rolls to wear and deformation by providing a perforated nonresilient press roll with a deformation resistant perforated outer shell and mounting said outer shell to the roll with elastic material. Stated another way, a perforated nonresilient press roll having a perforated deformation resistant outer shell mounted to the roll by an elastic material has been found to have both enhanced resilience and resistance to wear. The wear and deformation resistance is provided by the perforated outer shell, and the resilience is provided by the elastic material used to mount the outer shell to the roll. Pulp dewatering equipment utilizing resilient press rolls according to the invention provide extended surface contact between the rolls and pulp, which promotes dewatering by achieving the desired dry solids content of the pulp at a lower pressing force, thereby reducing the risk of fiber damage to the pulp and increasing the operational reliability of the press.

DETAILED DESCRIPTION OF THE PREFERRED EMBODIMENT

Figure 1:
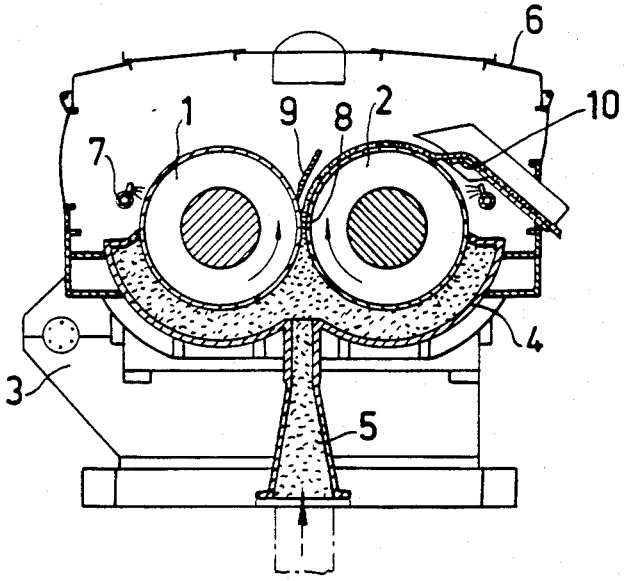
FIG. 1 shows schematically a lateral view of an embodiment of the present invention.
Figure 2:
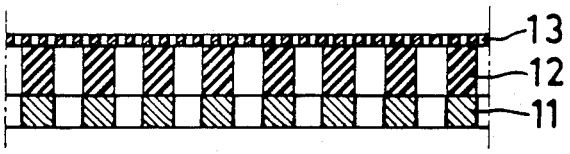
FIG. 2 is a cross-section on an enlarged scale through the shell surface of the press rolls of the present invention.

The elastic material mounting the wear and deformation resistant perforated outer shells to the perforated press rolls is preferably made from rubber, which is preferably vulcanized to mount the shells onto the rolls. The elastic material is preferably in the form of elastic supports attached to the roll in an axially-spaced relationship. The supports preferably have a width of 5–10 mm and a thickness of 8–15 mm. The distance between the supports is preferably 5–10 mm.

The wear and deformation resistant perforated shell (or sheet) is preferably fabricated from metal. The thickness of the shell is preferably 0.5–2.0 mm.

In accordance with the invention, the press comprises two rotatable press rolls (1, 2), which are supported in a stand (3). Beneath the rolls a trough (4) is arranged so as to partially enclose the rolls. Through an inlet (5), pulp is supplied to the trough. A hood (6) is located over the rolls and trough.

For cleaning the perforations in the rolls, spray pipes (7) are provided. The pulp received in the nip (8) between the rolls follows along the roll (2), guided by a first doctor blade (9). The pulp web thereafter is removed from the roll (2) by means of a second doctor blade (10).

The rolls are designed with a perforated nonresilient roll body (11), preferably in the form of a thick steel sheet provided with apertures. On this body a plurality of elastic supports (12) are attached all about in an axially spaced relationship. Outermost, a thin perforated shell (or sheet) (13) made of metal is attached to the roll by the elastic support.

By this design the two cooperating press rolls can form an extended nip between themselves. The perforated outer shells of the rolls yield when the pulp passes through the nip, yet maintain their shape and dewatering capacity. At a roll diameter of about 1 meter, the yield of the rolls can define an extended nip dimension of up to 30–50 mm, i.e., an extended nip of 3–5% of the roll diameter can be provided. This increases surface contact between the rolls and promotes dewatering, thereby achieving the desired dry solids content of the pulp, a lower maximum pressing force, a reduced risk of fiber damage, and an increased operational reliability of the press.

According to the embodiment shown, both rolls are provided with resilient shell surfaces. It is, however, possible to provide only one roll with such a surface, with the other roll having a shell surface of the conventional type.

The foregoing description and examples should be understood by way of illustration rather than by a limitation of the present invention as defined in the claims.

As will be appreciated, numerous variations and combinations of the features set forth in the foregoing description and examples can be utilized without departing from the present invention.

I claim:

1. A press for dewatering pulp comprising a rotatable first press roll, a rotatable second press roll having an overall roll diameter, said second press roll including a substantially rigid roll body having a plurality of first apertures therethrough, a perforated metal outer shell surrounding said roll body to provide an annular region therebetween, and resilient mounting means of elastic material disposed within said annular region for mounting said metal outer shell to said rigid roll body, said resilient mounting means having a plurality of continuously open second apertures in communication with said plurality of first apertures of said rigid roll body, said first press roll positioned juxtaposed said second press roll to provide an extended nip therebetween in the range of about 3 to 5% of said overall roll diameter upon yielding of said metal outer shell due to the presence of said elastic material upon passage of pulp between said first and second press rolls during the dewatering of pulp, and a trough arranged so as to partially enclose therebeneath said first press roll and said second press roll, and means for supplying pulp to said trough.

2. The press of claim 1, wherein said elastic material comprises rubber.

3. The press of claim 2, wherein said rubber is vulcanized.

4. The press of claim 1, wherein said elastic material comprises a plurality of elastic support members axially spaced about said roll body.

5. The press of claim 4, wherein said elastic support members have a width of between about 5 and 10 mm and a thickness of between about 8 and 15 mm.

6. The press of claim 5, wherein said elastic support members are axially spaced apart a distance of between about 5 and 10 mm.

7. The press of claim 1, wherein said outer shell has a thickness of between about 0.5 and 2 mm.

8. The press of claim 1, wherein said substantially rigid roll body comprises a first substantially rigid roll body, said perforated metal outer shell comprises a first perforated metal outer shell, and said resilient mounting means comprises a first resilient mounting means, and wherein said first press roll comprises a second substantially rigid roll body including a plurality of apertures therethrough, a second perforated metal outer shell surrounding said roll body, and second resilient mounting means mounting said second outer shell on said second roll body, said second resilient mounting means comprising elastic material, whereby said second outer shell is rendered yieldable during said dewatering of said pulp in said extended nip between said first and second nip rolls.

9. The press of claim 8, wherein said first and second outer shell surfaces are capable of yielding a sufficient amount so as to provide an extended nip of between 30 and 50 mm.

10. The press of claim 1, wherein said extended nip is in fluid communication with said trough for receiving pulp therefrom for dewatering.

* * * * *

UNITED STATES PATENT AND TRADEMARK OFFICE

CERTIFICATE OF CORRECTION

PATENT NO. : 4,861,433

DATED : August 29, 1989

INVENTOR(S) : Eriksson

It is certified that error appears in the above-identified patent and that said Letters Patent is hereby corrected as shown below: On the title page Please add --Foreign Application Priority Data

| | | |
|---|---|---|
| April 8, 1986 | Sweden | 8601569-0 |
| April 1, 1987 | PCT | SE87/00169-- |

Column 1, line 44, "pressure" should read --pressures--.

Signed and Sealed this

Eleventh Day of September, 1990

*Attest:*

HARRY F. MANBECK, JR.

*Attesting Officer*

*Commissioner of Patents and Trademarks*